US010809650B2

(12) United States Patent
Nedelin et al.

(10) Patent No.: US 10,809,650 B2
(45) Date of Patent: Oct. 20, 2020

(54) PRINTING LIQUIDS CONCENTRATION

(71) Applicant: HP INDIGO B.V., Amstelveen (NL)

(72) Inventors: Peter Nedelin, Ashdod (IL); Shai Lior, Rehovot (IL); Mark Sandler, Rehovot (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/772,342

(22) PCT Filed: Feb. 8, 2016

(86) PCT No.: PCT/EP2016/052641
§ 371 (c)(1),
(2) Date: Apr. 30, 2018

(87) PCT Pub. No.: WO2017/137065
PCT Pub. Date: Aug. 17, 2017

(65) Prior Publication Data

US 2018/0321620 A1 Nov. 8, 2018

(51) Int. Cl.
*G03G 15/11* (2006.01)
*G03G 15/10* (2006.01)

(52) U.S. Cl.
CPC ..... *G03G 15/11* (2013.01); *G03G 15/105* (2013.01)

(58) Field of Classification Search
None
See application file for complete search history.

(56) References Cited

U.S. PATENT DOCUMENTS

| | | | |
|---|---|---|---|
| 4,204,766 | A | 5/1980 | Harada |
| 4,761,357 | A | 8/1988 | Tavernier et al. |
| 4,974,027 | A | 11/1990 | Landa et al. |
| 5,383,008 | A | 1/1995 | Sheridon |
| 5,610,694 | A | 3/1997 | Lior et al. |
| 5,713,068 | A | 1/1998 | Teschendorf et al. |
| 5,915,153 | A | 6/1999 | Kim et al. |
| 5,933,689 | A | 8/1999 | Kim |
| 6,219,500 | B1 | 4/2001 | Byun |
| 6,324,368 | B1 | 11/2001 | Seto |
| 6,682,865 | B2 | 1/2004 | Viturro et al. |
| 6,850,724 | B2 | 2/2005 | Pang et al. |
| 6,856,778 | B2 | 2/2005 | Vejtasa et al. |
| 7,400,850 | B2 | 7/2008 | Romem |

(Continued)

FOREIGN PATENT DOCUMENTS

| | | |
|---|---|---|
| CN | 1209582 | 3/1999 |
| CN | 102812403 | 12/2012 |

(Continued)

*Primary Examiner* — Walter L Lindsay, Jr.
*Assistant Examiner* — Geoffrey T Evans
(74) *Attorney, Agent, or Firm* — HP Inc. Patent Department

(57) ABSTRACT

An example method includes concentrating first printing liquid on a conveyor. Concentrating the first printing liquid produces liquid carrier having a low non-volatile solid concentration. The method also includes concentrating the liquid carrier having the low non-volatile solid concentration on a developer roller. Concentrating the liquid carrier having the low non-volatile solid concentration produces liquid carrier substantially free of non-volatile solids. The method also includes delivering the liquid carrier substantially free of non-volatile solids to a storage vessel.

16 Claims, 6 Drawing Sheets

(56) References Cited

U.S. PATENT DOCUMENTS

| | | | |
|---|---|---|---|
| 7,471,907 | B2 | 12/2008 | Berg et al. |
| 7,544,458 | B2 | 6/2009 | Iraqi et al. |
| 8,055,160 | B2 | 11/2011 | Bhattacharyya et al. |
| 8,103,194 | B2 | 1/2012 | Patton et al. |
| 8,496,324 | B2 | 7/2013 | Anthony et al. |
| 9,327,295 | B2 | 5/2016 | Lior |
| 9,375,653 | B2 | 6/2016 | Sandler |
| 2003/0118361 | A1 | 6/2003 | Shimmura |
| 2007/0140738 | A1* | 6/2007 | Aruga ..... G03G 15/095 399/237 |
| 2009/0035023 | A1 | 2/2009 | Thompson et al. |
| 2009/0060587 | A1 | 3/2009 | Tanjo |
| 2013/0011162 | A1 | 1/2013 | Nelson et al. |
| 2014/0356029 | A1 | 12/2014 | Sandler |
| 2015/0209800 | A1 | 7/2015 | Lior |
| 2015/0298453 | A1 | 10/2015 | Gilan |
| 2018/0239273 | A1 | 8/2018 | Nelson |

FOREIGN PATENT DOCUMENTS

| | | | |
|---|---|---|---|
| EP | 2159269 | A1 | 3/2010 |
| GB | 1456210 | | 11/1976 |
| WO | WO-9301531 | | 1/1993 |
| WO | WO-2011123137 | | 10/2011 |
| WO | WO-2013034194 | | 3/2013 |
| WO | WO-2013107880 | | 7/2013 |
| WO | WO-2014015900 | | 1/2014 |
| WO | WO-2016015774 | | 2/2016 |

* cited by examiner

300

400

PRINTING LIQUIDS CONCENTRATION

BACKGROUND

Electro-photography (EP) printing devices may form images on a print target by selectively charging or discharging a photoconductive member, such as a photoconductive drum, based on an image to be printed. The selective charging or discharging may form a latent electrostatic image on the photoconductor. Colorants, or other printing liquids, may be developed onto the latent image of the photoconductor, and the colorant or printing liquid may be transferred to the media to form the image on the media. In dry EP (DEP) printing devices, powdered toner may be used as the colorant, and the toner may be received by the media as the media passes below the photoconductor. The toner may be fixed in place as it passes through heated pressure rollers. In some liquid EP (LEP) printing devices, printing liquid may be used as the colorant instead of toner. In some LEP devices, printing liquid may be developed in a developer unit and then selectively transferred to the photoconductor (a "zero transfer"). For example, the printing liquid may have a charge that causes it to be electrostatically attracted to the latent image on the photoconductor. The photoconductor may transfer the printing liquid to an intermediate transfer member (ITM), which may include a transfer blanket, (a "first transfer"), where it may be heated until a liquid carrier evaporates, or substantially evaporates, and resinous colorants melt. The ITM may transfer the resinous colorants to the surface of the print media (a "second transfer"), which may be supported on a rotating impression member (e.g., a rotating impression drum).

DETAILED DESCRIPTION

Figure 1:
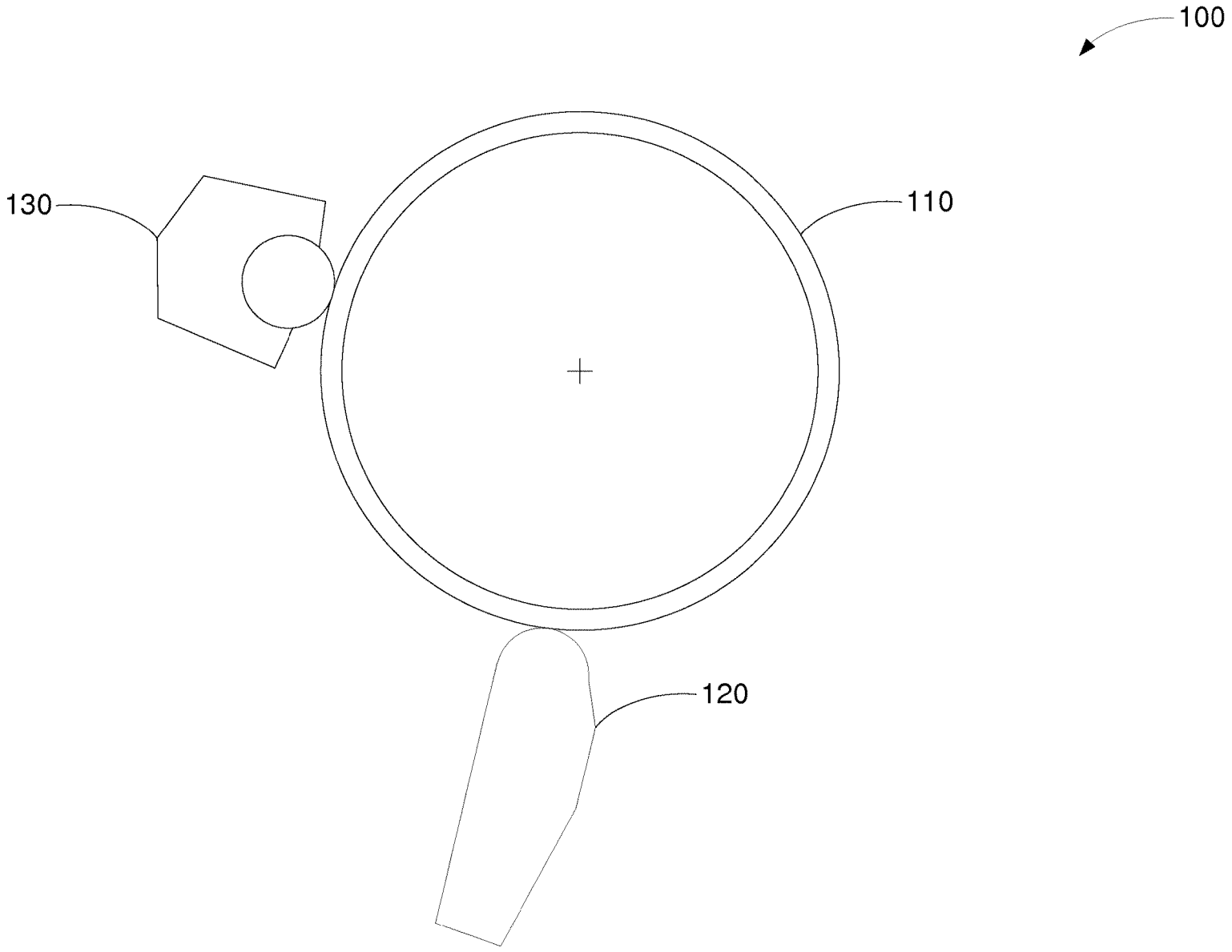
FIG. 1 is a schematic diagram of an example system to concentrate printing liquid and produce reusable liquid carrier.

The printing liquid may include the liquid carrier and non-volatile solids. The liquid carrier may be removed during printing, and the liquid carrier may become waste that needs to be processed by the user. The non-volatile solids may include the colorants that are melted and transferred to the surface of the print media. During manufacturing, the non-volatile solids may be thoroughly mixed in the liquid carrier to ensure an even distribution. In an example, the printing liquid may be mixed to a dilute non-volatile solid concentration of about 3% to 5%. As used herein, the term "non-volatile solid concentration" refers to the mass of the non-volatile solids in a quantity of printing liquid divided by the mass of the quantity of printing liquid including the non-volatile solids.

After the printing liquid has been mixed to the dilute non-volatile solid concentration, the printing liquid may be concentrated to a higher non-volatile solid concentration. Concentrating the printing liquid may decrease the weight that needs to be shipped for the same quantity of non-volatile solids (i.e., decreases the amount of printing liquid needed to print a particular number of pages). Because less weight is shipped, the shipping cost and environmental impact may be lower. In addition, less liquid carrier waste may be produced during printing. As a result, the end user may have less waste to process.

In an example, the printing liquid may be concentrated in a centrifuge. However, the centrifuge may be noisy and produce a significant amount of vibration. The centrifuge also may operate on small batches of printing liquid and take a long time to concentrate the printing liquid. In addition, the centrifuge may be difficult to clean after the printing liquid has been concentrated. Accordingly, the centrifuge may be inefficient for concentrating printing liquid.

Alternatively, the printing liquid may be concentrated on a conveyor electrophoretically using an electrode. The electrode and the conveyor may be maintained at a potential difference, and the printing liquid may be passed over the electrode. The potential difference may attract the non-volatile solids to the conveyor or repel the non-volatile solids from the electrode. Printing liquid with an increased concentration of non-volatile solids may be deposited on the conveyor. Waste printing liquid with little or no non-volatile solids may flow over the electrode, and the waste printing liquid may be deposited in a waste tank. The printing liquid with the increased concentration of non-volatile solids may be removed from the conveyor and placed in a storage vessel, such as a vessel to be shipped to an end user.

When concentrating the printing liquid with the electrode, the flow of printing liquid to the conveyor may be unstable and non-uniform. In addition, the printing liquid concentration along the width of the conveyor may be non-uniform. The non-volatile solid concentration that can be achieved with the electrode may be lower than desired. The electrode may be difficult to service. The electrode may be inaccessible, may be difficult to clean, and may need to be specially made. The electrode may also be difficult to calibrate and may need precise adjustment of the gap between the electrode and the conveyor. Concentration of printing liquids could be improved by remedying these issues.

In an example, a developer unit may concentrate printing liquid and transfer the printing liquid to the conveyor. The developer unit may provide the printing liquid at a high non-volatile solid concentration and at a high throughput. However, it would be beneficial to achieve higher concentrations and higher throughputs. In addition, the developer unit may allow for limited control on the concentration or throughput of the printing liquid concentration process. Accordingly, concentration of printing liquids could be improved by providing higher concentrations or throughputs as well as more precise control over the concentration or throughput achieved.

Liquid carrier may be removed from the printing liquid by the developer unit or by a squeegee unit that further concentrates the printing liquid. Some residual solids may remain in the liquid carrier after it is removed by the developer unit or the squeegee unit. The liquid carrier may not be pure enough to reuse in the manufacturing process. For example, the liquid carrier removed by the developer unit or the squeegee unit may have a non-volatile solid concentration of about 0.5% to 1%. In an example, the liquid carrier may be reused when it has a non-volatile solid concentration of less than 0.01%. Less waste could be produced, and manufacturing costs could be reduced by further reducing the non-volatile solid concentration of the liquid carrier efficiently.

FIG. 1 is a schematic diagram of an example system 100 to concentrate printing liquid and produce reusable liquid carrier. The system 100 may include a conveyor 110. In the illustrated example, the conveyor 110 may include a drum. The conveyor 110 may receive printing liquid at its surface and may retain the printing liquid on its surface, for example, electrostatically. The surface of the conveyor 110 may move to transport the printing liquid (e.g., continuously, periodically, aperiodically, or the like). For example, the conveyor 110 may rotate to transport the printing liquid about its circumference.

The system 100 may include a squeegee unit 130 to concentrate first printing liquid on the surface of the conveyor 110. For example, the squeegee unit 130 may apply mechanical or electrical forces to the first printing liquid to remove liquid carrier from the first printing liquid. The removal of the liquid carrier may increase the non-volatile solid concentration of the first printing liquid on the conveyor 110. The liquid carrier removed by the squeegee unit 130 may contain some residual non-volatile solids. Similarly, some liquid carrier may remain in the first printing liquid.

The system 100 may include a developer unit 120. As used herein, the term "developer unit" refers to a device to internally concentrate printing liquid electrophoretically and to deliver the concentrated printing liquid to a conveyor in contact with the developer unit, such as a photoconductor. In the illustrated example, the developer unit 120 may concentrate printing liquid and conduct the printing liquid to the conveyor 110 rather than delivering the concentrated printing liquid to a photoconductor. However, in some examples, the developer unit 120 may be structurally identical to developer units that deliver printing liquid to photoconductors. In an example, components of the developer unit 120 may be set to larger magnitude electrical potentials when used with the conveyor 110 rather than a photoconductor. In some examples, the developer unit 120 may concentrate the printing liquid as it transfers the printing liquid to the conveyor 110 in addition to internally concentrating the printing liquid prior to delivering it to the conveyor 110. The developer units 120 may include channels or conveyors to conduct the printing liquid to the conveyor 110.

The developer unit 120 may receive the liquid carrier removed by the squeegee unit 130. The developer unit 120 may concentrate the liquid carrier to separate the liquid carrier from the residual non-volatile solids and to produce second printing liquid containing the residual non-volatile solids. The liquid carrier may still contain residual non-volatile solids, but the concentration may be reduced. Similarly, the second printing liquid may contain liquid carrier, but the second printing liquid may have a higher non-volatile solid concentration than the liquid carrier removed by the squeegee unit 130. The developer unit 120 may apply mechanical or electrical force to the liquid carrier to separate the liquid carrier from the second printing liquid containing the residual non-volatile solids. The developer unit 120 may deliver the second printing liquid to the conveyor.

Figure 2:
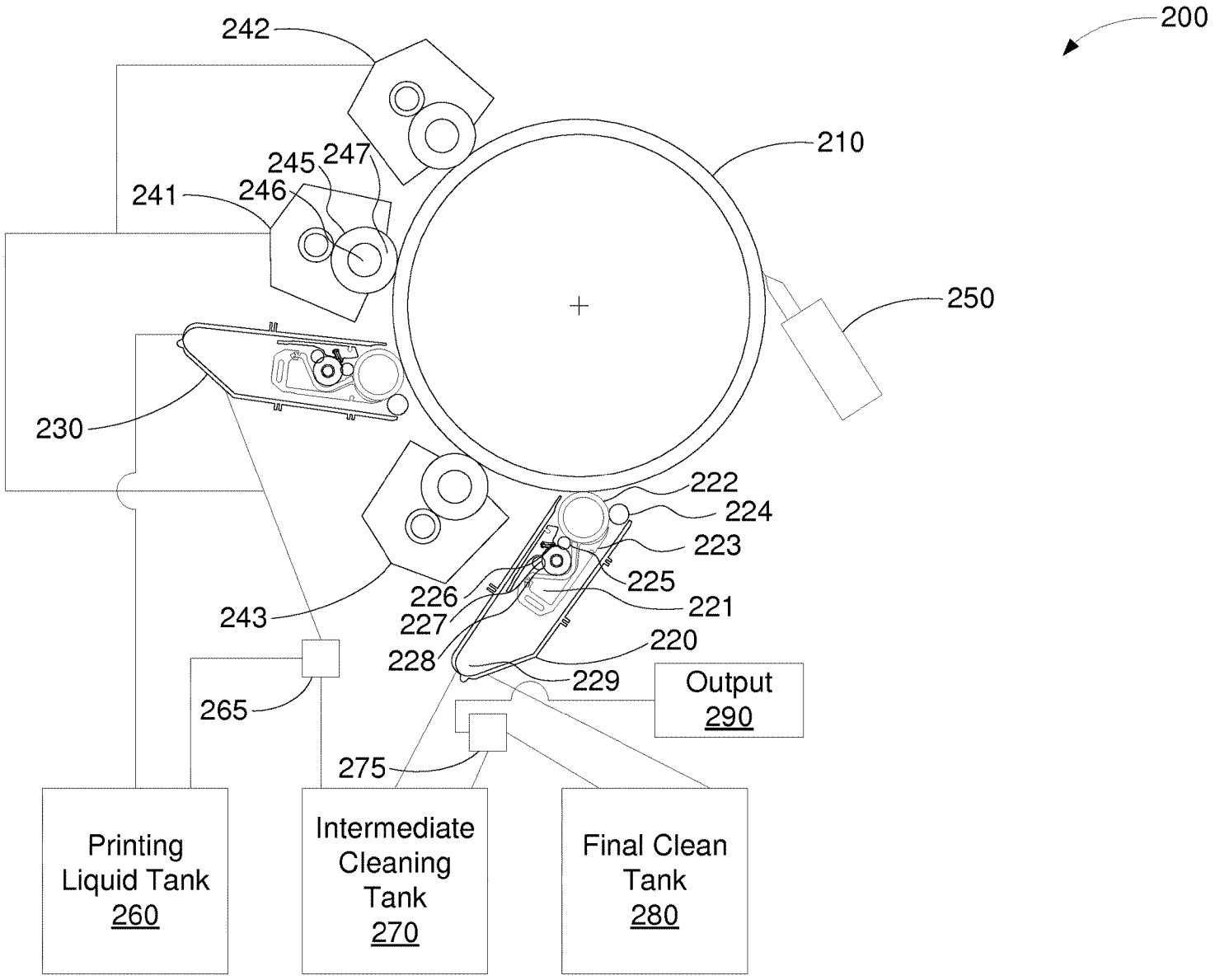
FIG. 2 is a schematic diagram of another example system to concentrate printing liquid and produce reusable liquid carrier.

FIG. 2 is a schematic diagram of another example system 200 to concentrate printing liquid and produce reusable liquid carrier. The system 200 may include a conveyor 210 to transport concentrated printing liquid on its surface. The conveyor 210 may have a continuous surface that forms a loop. In some examples, the conveyor 210 may include a rotatable drum. The surface of the conveyor 210 may support and transport the concentrated printing liquid. The conveyor 210 may have a potential applied to it, and non-volatile solids in the printing liquid may adhere to the conveyor 210 when the potential is applied. The conveyor 210 may include a metal, such as steel, aluminum, copper, an alloy of these metals, or the like. In an example, the conveyor 210 may include a metal substrate covered by a non-metallic material, such as a polymer, an elastomer, a ceramic, or the like.

The system 200 may include a printing liquid tank 260. The printing liquid tank 260 may store first printing liquid that is to be concentrated. For example, the printing liquid tank 260 may contain first printing liquid with a concentration of no more than 5% (e.g., less than 1%, 1% to 3%, 3% to 5%, etc.). In an example, the printing liquid tank may contain first printing liquid with a concentration of at least 2% (e.g., 2% to 3%, 3% to 5%, 5% to 7%, greater than 7%, etc.). The printing liquid tank 260 may deliver the first printing liquid to a second developer unit 230. The second developer unit 230 may concentrate the first printing liquid and deliver the first printing liquid to the conveyor 210.

The system 200 may include first and second squeegee units 241, 242. The first and second squeegee unit 241, 242 may further concentrate the first printing liquid on the surface of the conveyor 210. The first squeegee unit 241 may include a roller 245. In an example, the roller 245 may include a metallic core 246 and a non-metallic coating 247. The second squeegee unit 242 may include a similar structure. After the second developer unit 230 has concentrated the first printing liquid and delivered the first printing liquid to the conveyor 210, the conveyor 210 may transport the first printing liquid to the first and second squeegee units 241, 242. The first and second squeegee units 241, 242 may apply mechanical or electrical force to the first printing liquid on the conveyor 210 to concentrate the first printing liquid. For example, the roller 245 may be biased to a potential of at most about −500 V, −1000 V, −1500 V, −2000 V, −2500 V, −3000 V, −3500 V, −4000 V, or the like. The roller 245 may apply the electrical and mechanical forces to the first printing liquid on the surface of the conveyor 210. The roller 245 may rotate to apply a mechanical force to remove liquid carrier from the first printing liquid. The potential of the roller 245 may apply an electrical force that causes the non-volatile solids to remain on the surface of the conveyor 210. Thus, the concentration of the first printing liquid on the surface of the conveyor 210 may be increased. In an example, the second squeegee unit 242 may operate similarly to the first squeegee unit 241 to concentrate the printing liquid on the conveyor 210.

The first and second squeegee units 241, 242 may remove liquid carrier when concentrating the first printing liquid. Similarly, the second developer unit 230 may remove liquid carrier when concentrating the first printing liquid. In the illustrated example, a valve 265 controls whether the liquid carrier is returned to the printing liquid tank 260 or delivered to an intermediate cleaning tank 270. Alternatively, the first and second squeegee units 241, 242 and the second developer unit 230 may return the liquid carrier directly to the intermediate cleaning tank 270 without passing through a valve. In some examples, the first and second squeegee units 241, 242 may return liquid carrier return the intermediate cleaning tank 270, and the second developer unit 230 may deliver liquid carrier to the printing liquid tank 260 (or vice versa). The first and second squeegee units 241, 242 may return the liquid carrier to the same tank or different tanks.

The system 200 may include a first developer unit 220 to receive the liquid carrier from the intermediate cleaning tank 270. In an example, the liquid carrier from the intermediate cleaning tank 270 may have a non-volatile solid concentration of no more than 3% (e.g., no more than 0.5%, 0.5% to 1%, no more than 1%, 1% to 2%, 2% to 3%, etc.). The first developer unit 220 may concentrate the liquid carrier to produce second printing liquid and may deliver the second printing liquid to the conveyor 210. The first developer unit 220 may include a printing liquid inlet 221 at which it receives the liquid carrier. The inlet 221 may deliver the liquid carrier to a cavity of an electrode 223. The cavity of the electrode 223 may direct the flow of the liquid carrier to a developer roller 222. A potential may be applied to the developer roller 222. For example, the developer roller 222 may be biased to a potential of at most about −500 V, −1000 V, −1500 V, −2000 V, −2500 V, −3000 V, or the like. As used herein, the term "at most" refers to a value that is less than or equal to another value, and the term "at least" refers to a value that is greater than or equal to another value. For example, the value −3000 is less than the value −2500. There may be some error in the applied potential (e.g., an error of 0.1%, 0.5%, 1%, 2%, 5%, etc.). Thus, as used herein, the term "about" a particular voltage refers to a potential that is within an error margin of the particular voltage.

The electrode 223 may concentrate the liquid carrier on the developer roller 222 to produce the second printing liquid. In an example, the electrode 223 may be biased to a potential of at most about −1200 V, −1500 V, −2000 V, −2500 V, −3000 V, −3500 V, −4000 V, or the like. The magnitude of the potential of the electrode 223 may be greater than the magnitude of the potential of the developer roller 222. The residual non-volatile solids in the liquid carrier may be negatively charged, so the residual non-volatile solids may be repelled away from the electrode 223 and attach to the surface of the developer roller 222. Liquid carrier may attach to the surface of the developer roller 222 as well. Some liquid carrier with fewer or no residual non-volatile solids may flow over the electrode 223 and travel to an outlet 229. Accordingly, the electrode 223 may separate the liquid carrier from the residual non-volatile solids thereby concentrating the second printing liquid on the surface of the developer roller 222 and returning liquid carrier with a lower non-volatile solid concentration.

The developer roller 222 may rotate and transport the second printing liquid on its surface to a squeegee roller 224. The squeegee roller 224 may be biased to a potential of at most about −800 V, −1000 V, −1500 V, −2000 V, −2500 V, −3000 V, −3500 V, or the like. The magnitude of the potential of the squeegee roller 224 may be greater than the magnitude of the potential of the developer roller 222. The non-volatile solids may remain on the surface of the developer roller 222 due to the potential difference, but the squeegee roller 224 may apply a mechanical force that removes some of the liquid carrier on the developer roller 222. For example, the squeegee roller 224 may be in contact with the developer roller 222, and the squeegee roller 224 may rotate to pull the liquid carrier from the developer roller 222. The removal of the liquid carrier by the squeegee roller 224 may further concentrate the second printing liquid on the surface of the developer roller 222. The removed liquid carrier may have few non-volatile solids and may travel to the outlet 229.

The developer roller 222 may transport the second printing liquid concentrated by the electrode 223 and the squeegee roller 224 to the conveyor 210. In an example, the conveyor 210 may be biased to a potential of at least or at most about 1500 V, 1000 V, 500 V, 0 V, −500 V, or the like. The potential difference between the developer roller 222 and the conveyor 210 may cause the second printing liquid, including the non-volatile solids, to transfer from the developer roller 222 to the conveyor 210. The second printing liquid may form an initial layer of printing liquid on the conveyor 210. In some examples, some liquid carrier with little or no non-volatile solids may remain on the developer roller 222, and the second printing liquid may be further concentrated during the transfer to the conveyor 210. The concentrated printing liquid on the conveyor 210 may be a non-Newtonian fluid and may have a paste consistency.

The developer roller 222 may be cleaned to remove any printing liquid that did not transfer to the conveyor 210. The developer unit 210 may include a cleaner roller 225 to remove the printing liquid remaining on the developer roller 222. The cleaner roller 225 may be at a positive or negative potential relative to the developer unit 210 depending on whether the cleaner roller 225 is to remove non-volatile solids or just liquid carrier. In an example, the cleaner roller 225 may be biased to a potential of at most or at least about −250 V, −500 V, −1000 V, −1500 V, −2000 V, −2500 V, −3000 V, −3500 V, or the like. A wiper 226 may remove printing liquid from the cleaner roller 225. A sponge roller 227 may move the printing liquid away from the vicinity of the cleaner roller 225 and the wiper 226. A squeezer roller 228 may remove the printing liquid from the sponge roller 227 so that it can drain to the outlet 229.

The outlet 229 may be connected to a final clean tank 280 so that liquid carrier removed by the first developer unit 220 travels to the final clean tank 280. In an example, the liquid carrier removed by the first developer unit 220 may be substantially free of non-volatile solids and clean enough to reuse. For example, the liquid carrier may be substantially free of non-volatile solids when it has a non-volatile solid concentration of no more than 0.001%, 0.002%, 0.005%, 0.01%, 0.02%, 0.05%, 0.1%, 0.2%, 0.5%, or the like. Alternatively, or in addition, the first developer unit 220 may process the liquid carrier multiple times to achieve a particular non-volatile solid concentration. In the illustrated example, the final clean tank 280 may be connected to the intermediate clean tank 270 by a valve 275. If the non-volatile solid concentration of the liquid carrier is above a particular threshold, the valve may direct the liquid carrier to the intermediate cleaning tank 270 for further processing by the first developer unit 220. If the non-volatile solid concentration is below the particular threshold, the valve 275 may direct the liquid carrier to an output 290, where it may travel to a storage vessel or to further processing. The concentration may be measured with an optical sensor (not shown), and the valve 275 may be controlled based on the measurements. Similarly, in some examples, the valve 265 may be controlled based on optical sensor measurements of the concentration of the print liquid tank 260 or the intermediate cleaning tank 270.

The conveyor 210 may transport the second printing liquid to a third squeegee unit 243. The third squeegee unit 243 may be between the first developer unit 220 and the second developer unit 230. The third squeegee unit 243 may further concentrate the second printing liquid on the conveyor 210. In an example, the third squeegee unit 243 may not act on the first printing liquid, which may be added to the conveyor 210 at a location after that of the third squeegee unit 243. The third squeegee unit 243 may operate similarly to the first squeegee unit 241 to concentrate the printing liquid on the conveyor 210. The conveyor 210 may transport the second printing liquid to the second developer unit 230. The second developer unit 230 may deliver the first printing liquid on top of the second printing liquid. For example, the conveyor 210 or the second developer unit 230 may apply mechanical or electrical forces to the first printing liquid. The mechanical or electrical forces may transfer the first printing liquid to the surface of the conveyor 210 despite the presence of the second printing liquid. The first and second printing liquid may mix and become indistinguishable after delivery of the first printing liquid to the conveyor 210. The second developer unit 230 may include a similar structure to the first developer unit 220 to concentrate the second printing fluid internally, or the second developer unit 230 may include a distinct structure.

After the second developer unit 230 has added the first printing liquid, the conveyor 210 may transport the first and second printing liquid to the first and second squeegee units 241, 242 in turn. The first and second squeegees unit 241, 242 may concentrate the first printing liquid further. In some examples, the first and second squeegee units 241, 242 may concentrate the second printing liquid further as well. The conveyor 210 may transport the first and second printing liquid from the second squeegee unit 242 to a wiper 250. The wiper 250 may remove the first and second printing liquid from the conveyor 210. In an example, the wiper 250 may include a plate or blade of a rigid material, such as a metal or polymer, in contact with the conveyor 210. The wiper may span the width of the conveyor. The wiper 250 may scrape the first and second printing liquid from the surface of the conveyor 210 to remove the printing liquid. The printing liquid may travel down the wiper 250. For example, gravity may pull the printing liquid down the wiper 250. Alternatively, or in addition, the rotation of the conveyor 210 may continuously push additional printing liquid onto the wiper 250, which in turn may push the printing liquid already on the wiper 250. The wiper 250 may transport the printing liquid to further processing or to a storage vessel (not shown), such as a storage vessel to be shipped to a user.

In an example, the second developer unit 230 may receive the first printing liquid at a non-volatile solid concentration of no more than 5% (e.g., less than 1%, 1% to 3%, 3% to 5%, etc.), at least 2% (e.g., 2% to 3%, 3% to 5%, 5% to 7%, greater than 7%, etc.), or the like. In some examples, the second developer unit 230 may concentrate the first printing liquid to a non-volatile solid concentration of at least 13%, 15%, 18%, 20%, 23%, 25%, or the like. The first developer unit 220 may receive the liquid carrier with a non-volatile solid concentration of no more than 3% (e.g., no more than 0.5%, 0.5% to 1%, no more than 1%, 1% to 2%, 2% to 3%, etc.), but the first developer unit 220 may concentrate the second printing liquid to a non-volatile solid concentration of at least 13%, 15%, 18%, 20%, 23%, 25%, or the like. The first developer unit 220 may deliver less printing liquid to the conveyor 210 than the second developer unit 230, but the concentration may be similar. The third squeegee unit 243 may further concentrate the second printing liquid to a non-volatile solid concentration of at least 15%, 20%, 25%, 30%, 35%, 40%, 45%, 50%, or the like. The overall non-volatile solid concentration of the first and second printing liquids after the further concentration by the first and second squeegee units 241, 242 may be at least 25%, 30%, 35%, 40%, 45%, 50%, 55%, 60%, or the like. The printing liquid may be provided to the end user at that concentration.

The system 200 may output concentrated printing liquid at a normalized rate of at least seven, eight, nine, ten, 13, 15, 18, or the like kilograms per hour. As used herein, the term "normalized rate" refers to a rate corrected for the concentration of the printing liquid. For example, the rate may be normalized to that of a liquid with a 100% non-volatile solid concentration. The first and second developer units 220, 230 may produce a layer on the conveyor 210 with a thickness of at least 1 micrometer (μm), 2 μm, 3 μm, 4 μm, 5 μm, 6 μm, 7 μm, 8 μm, or the like. The thickness may be before or after further concentration by the squeegee units 241, 242, 243. The second developer unit 230 may be dedicated to concentrating printing liquid while the first developer unit 220 is directed to cleaning the liquid carrier produced by the second developer unit 230. Accordingly, the system 200 may produce printing liquid with a high non-volatile solid concentration at a high rate while also producing liquid carrier with a low non-volatile solid concentration. Although the illustrated example includes two developer units 220, 230 and three squeegee units 241, 242, 243, other examples may include more or fewer developer units, more or fewer squeegee units, or a different arrangement of developer units and squeegee units around the circumference of the conveyor.

The first and second developer units 220, 230 may provide a stable and uniform flow of printing liquid to the conveyor 210, and the first and second developer units 220, 230 may deliver a uniform concentration of printing liquid along the entire width of the conveyor 210. The first and second developer units 220, 230 may be accessed easily and may be a mass produced printer part that can be replaced inexpensively and quickly when servicing the system 200. In addition, there may be no need to align or clean a gap between the first and second developer units 220, 230 and the conveyor 210. Thus, the system 200 may provide excellent performance concentrating printing liquid with low maintenance costs. Moreover, the system 200 may produce liquid carrier with a low enough non-volatile solid concentration that the liquid carrier can be reused in the printing liquid manufacturing process. In addition, when the non-volatile solid concentration is being reduced to the threshold for reuse, additional concentrated printing liquid may be produced as well. The amount of waste produced during manufacture may be reduced as well as the amount of liquid carrier that needs to be purchased for the manufacturing process.

Figure 3:
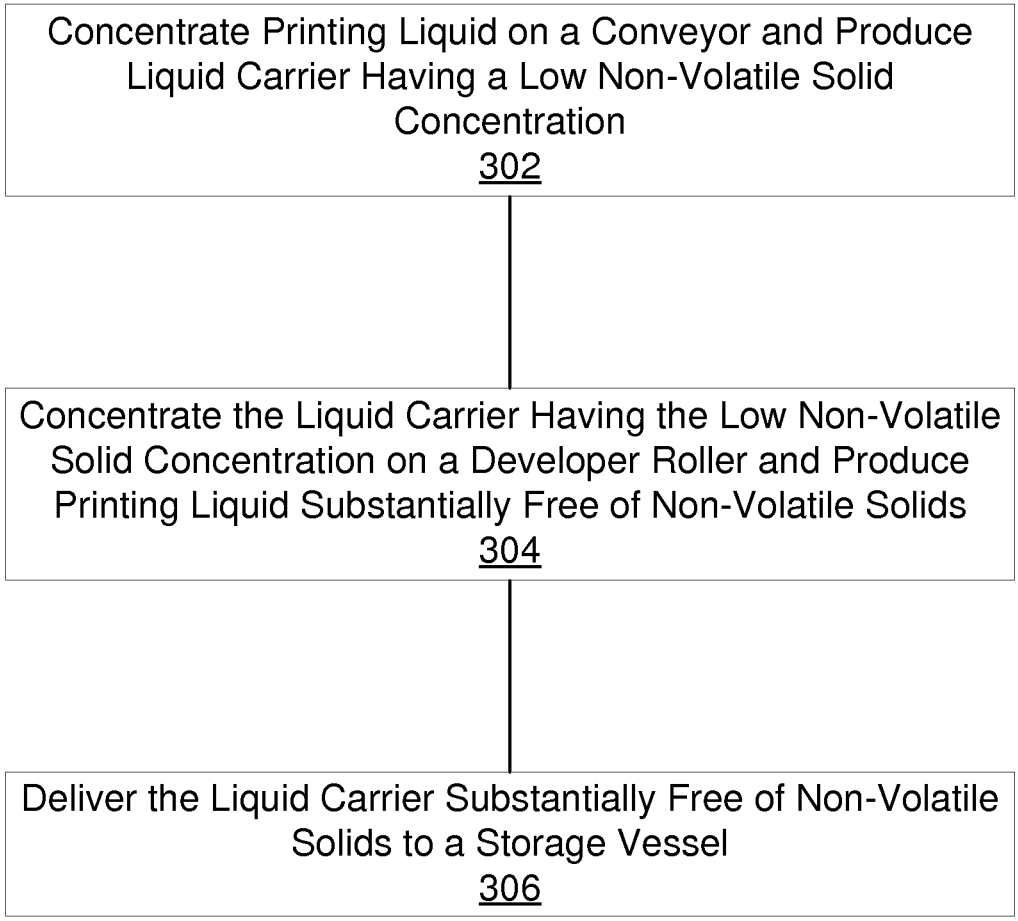
FIG. 3 is a flow diagram of an example method to concentrate printing liquid and produce reusable liquid carrier.

FIG. 3 is a flow diagram of an example method 300 to concentrate printing liquid and produce reusable liquid carrier. At block 302, the method 300 may include concentrating printing liquid on a conveyor. Concentrating the printing liquid may produce liquid carrier having a low non-volatile solid concentration. For example, liquid carrier may be removed from the printing liquid to increase the non-volatile solid concentration, and the removed liquid carrier may contain residual non-volatile solids. Mechanical or electrical force may be applied to the printing liquid to concentrate the printing liquid. For example, an electrical force may be applied to the non-volatile solids to drive the non-volatile solids toward the conveyor, and a mechanical force may be applied to remove the liquid carrier from the printing liquid.

Block 304 may include concentrating the liquid carrier having the low non-volatile solid concentration on a developer roller. The liquid carrier having the low non-volatile solid concentration may be delivered to the developer roller. Liquid carrier may be removed to increase the non-volatile solid concentration. For example, mechanical or electrical force may be applied to the liquid carrier having the low non-volatile solid concentration. The liquid carrier removed may be substantially free of non-volatile solids. As used herein, the term "substantially free of non-volatile solids" refers to having a non-volatile solid concentration below a threshold for reusing the liquid carrier.

At block 306, the method 300 may include delivering the liquid carrier substantially free of non-volatile solids to a storage vessel. The liquid carrier substantially free of non-volatile solids may be delivered directly to the storage vessel or may be delivered indirectly, for example by travelling to a tank first. The liquid carrier may be pumped to the storage vessel, or gravity may transport the liquid carrier to the storage vessel. In an example, the first squeegee unit 241 of FIG. 2 may perform block 302; the first developer unit 220 may perform block 304; and the first developer unit 220 (e.g., the outlet 229) or the valve 275 may perform block 306.

Figure 4:
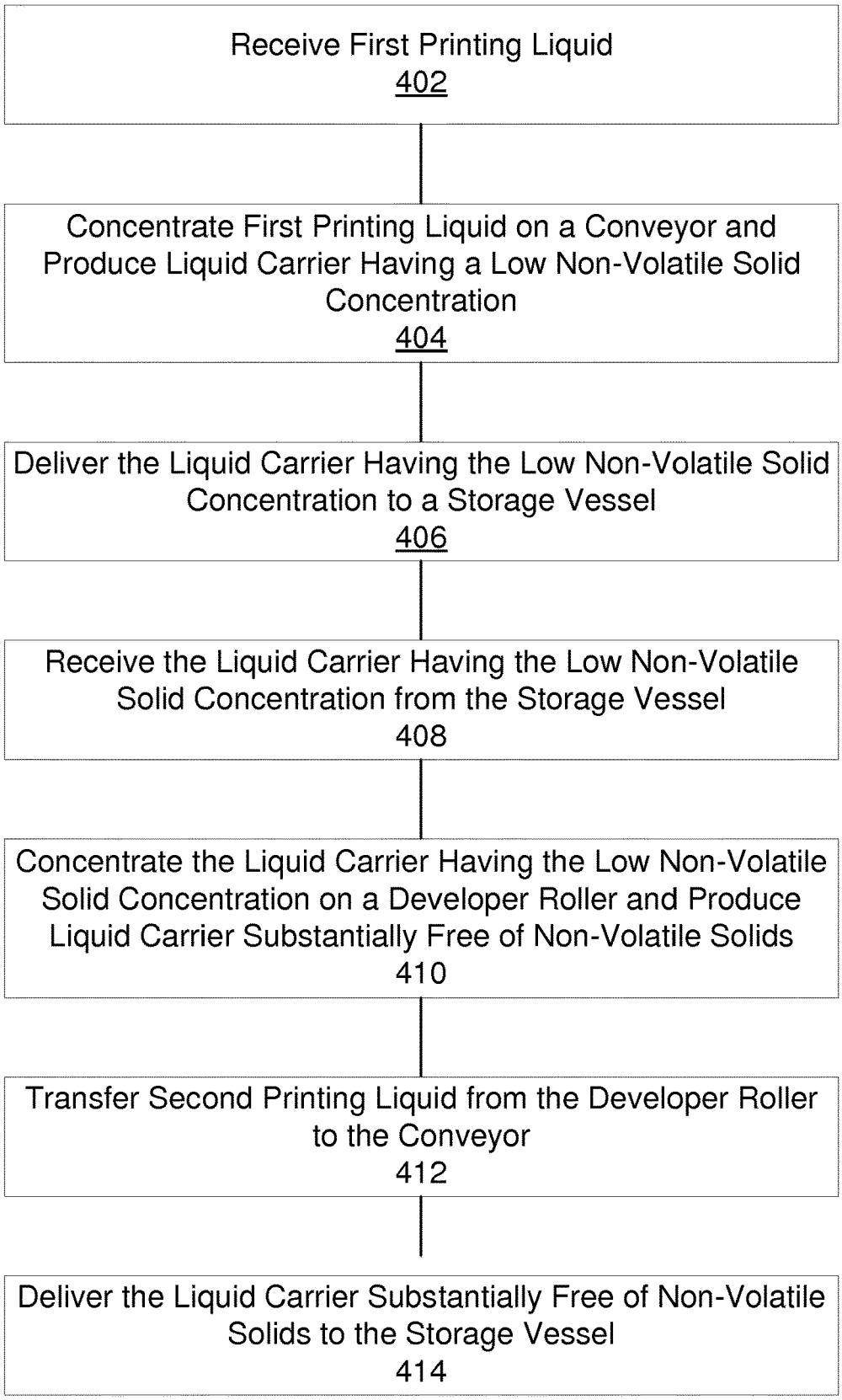
FIG. 4 is a flow diagram of another example method to concentrate printing liquid and produce reusable liquid carrier.

FIG. 4 is a flow diagram of another example method 400 to concentrate printing liquid and produce reusable liquid carrier. At block 402, the method 400 may include receiving first printing liquid. For example, the first printing liquid may be received at a second electrode cavity and may be received from a printing liquid tank. In an example, a second developer unit may include the second electrode cavity and an adjacent inlet connected to the printing liquid tank. The first printing liquid may flow into the second electrode cavity from the inlet. The first printing liquid may flow through the second electrode cavity to a second developer roller. The first printing liquid may arrive at the surface of the second developer roller, and the second developer roller may transport the first printing liquid away from the second electrode cavity. In an example, the first printing liquid received at the second electrode cavity may include a non-volatile solid concentration of at least 2% (e.g., 2% to 3%, 3% to 5%, 5% to 7%, greater than 7%, etc.), no more than 5% (e.g., less than 1%, 1% to 3%, 3% to 5%, etc.), or the like.

Block 404 may include concentrating the first printing liquid on a conveyor. The first printing liquid may be concentrated on the second developer roller and transferred to the conveyor, or a first squeegee unit may concentrate the first printing liquid while it is on the conveyor. The second developer unit may include a second electrode (e.g., a second electrode defining the second electrode cavity), which may provide an electrical force that repels non-volatile solids from the second electrode and toward the second developer roller. For example, the non-volatile solids may have a negative charge, and the second electrode may be set to a lower electrical potential than the second developer roller. Liquid carrier may flow over the second electrode and away from the second developer roller while the non-volatile solids remain on the second developer roller. Alternatively, or in addition, the second developer roller may transport the first printing liquid to a second squeegee roller. The second squeegee roller may apply mechanical or electrical force to the first printing liquid on the second developer roller. For example, the second squeegee roller may be set to a lower electrical potential than the second developer roller, but its rotation may carry the first printing liquid away from the second developer roller. As a result, the mechanical and electrical forces may pull liquid carrier away from the second developer roller while pushing non-volatile solids towards the second developer roller. The second electrode or second squeegee roller may increase the concentration of non-volatile solids by removing the liquid carrier from the second developer roller while the non-volatile solids remain on the second developer roller.

The second developer roller may transfer the first printing liquid to the conveyor. The second developer roller may be in contact with the conveyor, and the second developer roller and conveyor may rotate, which may pull the first printing liquid off the developer roller. In addition, the conveyor may be at a higher electrical potential than the second developer roller to drive negatively charged non-volatile solids in the first printing liquid toward the conveyor. The rotation and electrical potential may apply mechanical and electrical forces on the first printing liquid that cause the first printing liquid to transfer from the second developer roller to the conveyor. The non-volatile solid concentration of the first printing liquid may or may not increase when it is transferred to the conveyor. The first printing liquid transferred to the conveyor may have a non-volatile solid concentration of at least 13%, 15%, 18%, 20%, 23%, 25%, or the like.

Alternatively, or in addition, the first squeegee unit may apply electrical or mechanical force to the first printing liquid to remove liquid carrier from the first printing liquid without removing non-volatile solids. The first squeegee unit may include a roller that rotates to pull the liquid carrier away from the conveyor while an electrical potential between the roller and the conveyor pushes non-volatile solids towards the conveyor. The first printing liquid that remains on the conveyor may have a higher non-volatile solid concentration after the liquid carrier is removed. In some examples, a second squeegee unit may also concentrate the first printing liquid. The number of squeegee units used to concentrate the first printing liquid may be selected based on the desired non-volatile solid concentration. The first printing liquid may be further concentrated to a non-volatile solid concentration of at least 25%, 30%, 35%, 40%, 45%, 50%, 55%, 60%, or the like.

The liquid carrier removed by the second developer unit or the first or second squeegee units may have a low non-volatile solid concentration, such as a non-volatile solid concentration of no more than 3% (e.g., no more than 0.5%, 0.5% to 1%, no more than 1%, 1% to 2%, 2% to 3%, etc.). Block 406 may include delivering the liquid carrier having the low non-volatile solid concentration to a storage vessel. For example, the second developer unit may include an outlet that returns the liquid carrier to the storage vessel, or a valve may direct the liquid carrier to the storage vessel rather than the printing liquid tank. Gravity or a pump may be used to deliver the liquid carrier to the storage vessel. Block 408 may include receiving the liquid carrier having the low non-volatile solid concentration from the storage vessel. For example, the liquid carrier having the low non-volatile solid concentration may be received at a first electrode cavity. A first developer unit may include the first electrode cavity and an adjacent inlet at which the first developer unit receives the liquid carrier. The first electrode cavity may direct the liquid carrier to a first developer roller.

At block 410, the method 400 may include concentrating the liquid carrier having the low non-volatile solid concentration on the first developer roller. The first developer roller may transport the liquid carrier past a first electrode or a first squeegee roller. The first electrode or first squeegee roller may apply electrical or mechanical force to the liquid carrier. The electrical or mechanical force may remove liquid carrier substantially free of non-volatile solids and produce concentrated second printing liquid on the first developer roller. Block 412 may include transferring the second printing liquid from the first developer roller to the conveyor. The first developer roller or the conveyor may apply mechanical or electrical force to the second printing liquid to transfer the second printing liquid to the conveyor. The concentration of the second printing liquid may or may not increase when it is transferred to the conveyor. After transfer to the conveyor, the second printing liquid may have a non-volatile solid concentration of at least 13%, 15%, 18%, 20%, 23%, 25%, or the like. The second printing liquid may be further concentrated on the conveyor, for example, by a third squeegee unit. In an example, the first printing liquid may be transferred by the second developer unit on top of the second printing liquid. After concentration of the first or second printing liquid by the first and second squeegee units, the first and second printing liquid may be removed from the conveyor (e.g., by a wiper) for further processing or storage (e.g., prior to shipping to an end user).

Block 414 may include delivering the liquid carrier substantially free of non-volatile solids to the storage vessel. For example, the first developer unit may include an outlet that returns the liquid carrier substantially free of non-volatile solids to the storage vessel. In an example, the first developer unit may receive the liquid carrier having the low non-volatile solid concentration from the same storage vessel to which the first developer unit returns the liquid carrier substantially free of non-volatile solids. The first developer unit may continue to process the liquid carrier from the storage vessel until the non-volatile solid concentration has dropped below a predetermined threshold, such as a non-volatile solid concentration of no more than 0.001%, 0.002%, 0.005%, 0.01%, 0.02%, 0.05%, 0.1%, 0.2%, 0.5%, or the like. An optical sensor may measure the non-volatile solid concentration. After the non-volatile solid concentration has dropped below the predetermined threshold, the contents of the storage vessel may be reused in the manufacturing process. The normative rate at which the first developer unit transfers the second printing liquid to the conveyor may decrease as the non-volatile solid concentration of the liquid carrier in the storage vessel decreases, but the concentration of the second printing liquid delivered to the conveyor may remain about the same. Referring to FIG. 2, the second developer unit 220 or the first squeegee unit 241, for example, may perform blocks 402, 404, and 406, and the first developer unit 220, for example, may perform blocks 408, 410, 412, and 414.

Figure 5:
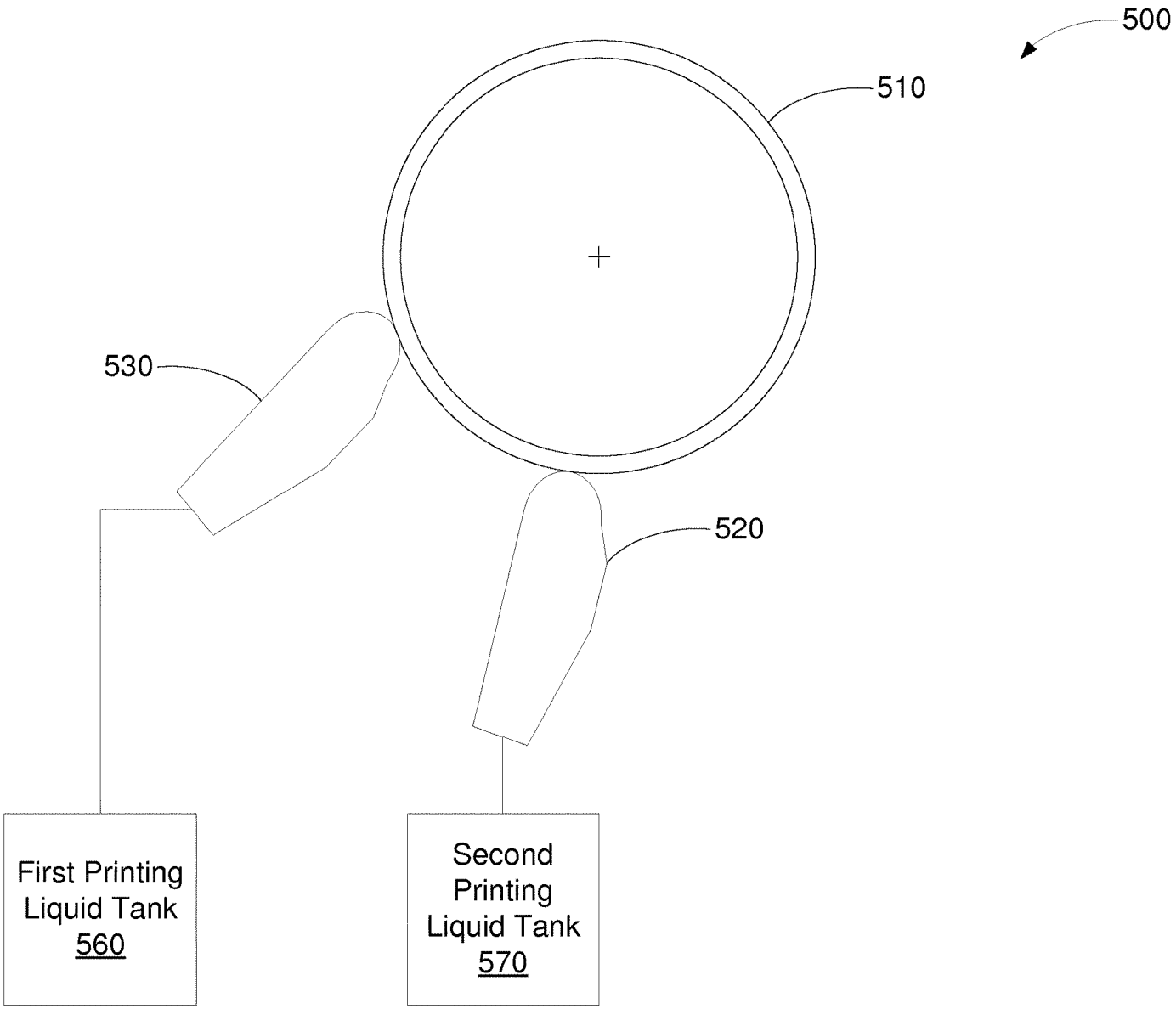
FIG. 5 is a schematic diagram of an example apparatus to concentrate printing liquid and produce reusable liquid carrier.

FIG. 5 is a schematic diagram of an example apparatus 500 to concentrate printing liquid and produce reusable liquid carrier. The apparatus 500 may include a conveyor 510. The conveyor 510 may carry printing liquid on its surface and transport the printing liquid. For example, the surface of the conveyor 510 may move to transport the printing liquid. In an example, the surface may move in a loop. In the illustrated example, the conveyor 510 may include a drum, which may transport the printing liquid by rotating.

The apparatus 500 may also include first and second developer units 520, 530. The first and second developer units 520, 530 may concentrate first and second printing liquid respectively. For example, the first and second developer units 520, 530 may remove liquid carrier from the first and second printing liquids to increase the concentration of non-volatile solids in the first and second printing liquid. The first developer unit 520 may deliver the first printing liquid to the surface of the conveyor 510, and the second developer unit 530 may deliver the second printing liquid to the conveyor 510. The second developer unit 530 may deliver the second printing liquid on top of the first printing liquid.

The apparatus 500 may include a first printing liquid tank 560 and a second printing liquid tank 570. The first developer unit 520 may be connected to the first printing liquid tank 560. The first developer unit 520 may receive the first printing liquid from the first printing liquid tank 560. Similarly, the second developer unit 530 may be connected to the second printing liquid tank 570, and the second developer unit 530 may receive the second printing liquid from the second printing liquid tank 570.

Figure 6:
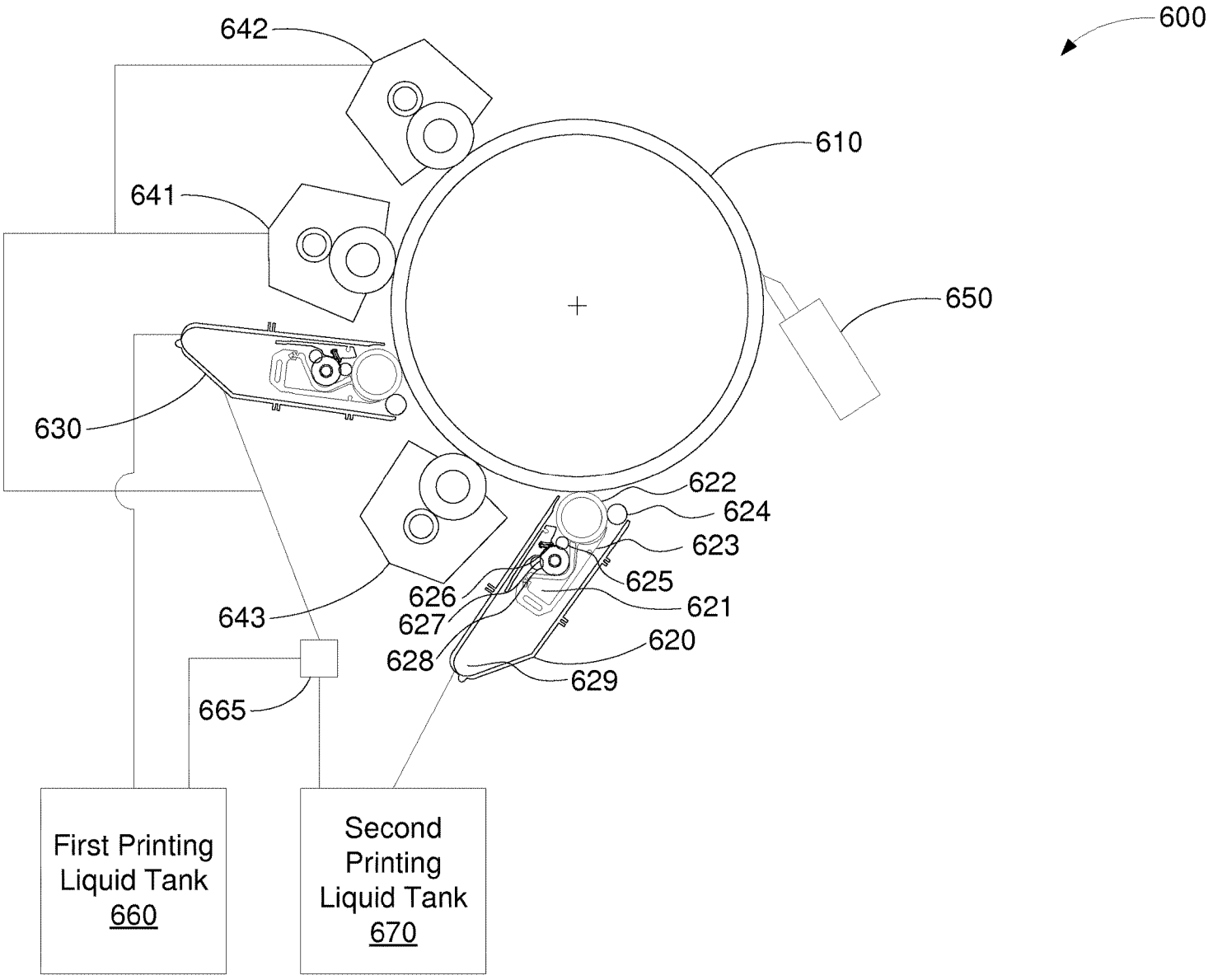
FIG. 6 is a schematic diagram of another example apparatus to concentrate printing liquid and produce reusable liquid carrier.

FIG. 6 is a schematic diagram of another example apparatus 600 to concentrate printing liquid and produce reusable liquid carrier. The apparatus 600 may include a conveyor 610 to transport printing liquid. For example, the conveyor 610 may include a rotating drum to transport the printing liquid. The apparatus 600 may also include first and second developer units 620, 630. In an example, the first developer unit 620 may include a liquid inlet 621 to receive second printing liquid and to conduct the second printing liquid to a developer roller 622. The first developer unit 620 may concentrate the second printing liquid on the developer roller 622. For example, the first developer unit 620 may apply mechanical or electrical forces to the second printing liquid on the developer roller 622 to remove liquid carrier from the second printing liquid thereby increasing the concentration of non-volatile solids in the second printing liquid. An electrode 623 or squeegee roller 624 may apply the mechanical or electrical forces to the second printing liquid to concentrate the second printing liquid.

After concentrating the second printing liquid, the first developer unit 620 may deliver the second printing liquid to the conveyor 610. The developer roller 622 may transport the second printing liquid to the conveyor 610, for example, by rotating the second printing liquid until it reaches the conveyor 610. The developer roller 622 and the conveyor 610 may apply mechanical or electrical force to the second printing liquid to transfer the first printing liquid to the conveyor 610. The first developer unit 620 may also include a cleaner roller 625. The cleaner roller 625 may remove any remaining second printing liquid from the developer roller 622. The cleaner roller 625 may remove liquid carrier from the developer roller 622 without removing non-volatile solids or may remove non-volatile solids from the developer roller 622. The first developer unit 620 may include a wiper 626, a sponge roller 627, and a squeezer roller 628 to remove the second printing liquid from the cleaner roller 625 and to transport the first printing liquid to an outlet 629.

The second developer unit 630 may concentrate first printing liquid and deliver the first printing liquid to the conveyor 610. In some examples, the second developer unit 630 may include similar elements and a similar structure to the first developer unit 620. The second developer unit 630 may deliver the first printing liquid on top of the second printing liquid. The first or second developer unit 620, 630 may form a thick layer on the conveyor 610 from the first or second printing liquids. As used herein, the term forming a "thick layer" refers to the first and second developer units 620, 630 producing a layer with a thickness of at least 1 μm, 2 μm, 3 μm, 4 μm, 5 μm, 6 μm, 7 μm, 8 μm, or the like. The first and second developer units 620, 630 may deliver printing liquid to the conveyor 610 at a combined normalized rate of at least seven, eight, nine, ten, 13, 15, 18, or the like kilograms per hour. The first and second developer units 620, 630 may operate at large magnitude potentials to produce the thick layer from the first and second printing liquids.

In some examples, a potential of at most about −500 V, −1000 V, −1500 V, −2000 V, −2500 V, −3000 V, or the like may be applied to the developer roller 622. The electrical potentials of the electrode 623 and the squeegee roller 624 may be less or much less than the potential of the developer roller 622 to concentrate the first printing liquid on the developer roller 622. For example, the electrode 623 may be at a potential of at most about −1200 V, −1500 V, −2000 V, −2500 V, −3000 V, −3500 V, −4000 V, or the like to the electrode 623, and the squeegee roller 624 may be at a potential of at most about −800 V, −1000 V, −1500 V, −2000 V, −2500 V, −3000 V, −3500 V, or the like. The conveyor 610 may be at an electrical potential that is greater or much greater than the electrical potential of the developer roller 622 to transfer the first printing liquid to the conveyor 610. The conveyor 610 may be at a potential of at least or at most about 1500 V, 1000 V, 500 V, 0 V, −500 V, or the like. The potential of the cleaner roller 625 may be greater than or less than the potential of the developer roller 622. For example, the cleaner roller 625 may be at a potential less than the developer roller 622 so that the cleaner roller 625 removes liquid carrier from the developer roller 622 but does not remove non-volatile solids from the developer roller 622. The cleaner roller 625 may be at a potential of at most or at least about −250 V, −500 V, −1000 V, −1500 V, −2000 V, −2500 V, −3000 V, −3500 V, or the like. The potentials may have large magnitudes to allow for concentration of more printing liquid and to provide a higher throughput. The second developer unit 630 may have similar potentials to the first developer unit 620.

The second developer unit 630 may be connected to a first printing liquid tank 660, and the first developer unit 620 may be connected to a second printing liquid tank 670. The second developer unit 630 may receive the first printing liquid from the first printing liquid tank 660, and the first developer unit 620 may receive the second printing liquid from the second printing liquid tank 670. In an example, the first printing liquid tank 660 may contain freshly manufactured printing liquid that is to be concentrated. The freshly manufactured printing liquid 660 may not have undergone any processing or concentration by the apparatus 600. In contrast, the second printing liquid tank 670 may receive liquid carrier removed by the second developer unit 630 (e.g., via an outlet of the second developer unit 630) or one of a plurality of squeegee units 641, 642, 643 during concentration of the first or second printing liquid. In some examples, the second printing liquid tank 670 may receive liquid carrier removed by the first developer unit 620 as well (e.g., via the outlet 629 of the first developer unit 620).

In the illustrated example, the apparatus 600 may include a valve 665 to select whether liquid carrier removed by the second developer unit 630 and first and second squeegee units 641, 642 is returned to the first printing liquid tank 660 or the second printing liquid tank 670. For example, the valve 665 may return the liquid carrier to the first printing liquid tank 660 until the non-volatile solid concentration of the contents of the first printing liquid tank drops below a predetermined threshold. At that point, the valve 665 may be switched so that it returns the liquid carrier to the second printing liquid tank 670. In an example, the first developer unit 620 may concentrate the second printing liquid from the second printing liquid tank 670 and return the removed liquid carrier to the second printing liquid tank 670 until the concentration drops below a predetermined threshold. For example, an optical sensor may determine when the non-volatile solid concentration is no more than 0.001%, 0.002%, 0.005%, 0.01%, 0.02%, 0.05%, 0.1%, 0.2%, 0.5%, or the like. Then, the liquid carrier in the second printing liquid tank 670 may be reused in the printing liquid manufacturing process.

The apparatus 600 may also produce concentrated printing liquid that can be provided to end users. For example, the first developer unit 620 may concentrate the second printing liquid from a non-volatile solid concentration of no more than 3% (e.g., no more than 0.5%, 0.5% to 1%, no more than 1%, 1% to 2%, 2% to 3%, etc.) to a non-volatile solid concentration of at least 13%, 15%, 18%, 20%, 23%, 25%, or the like. The third squeegee unit 643 may concentrate the second printing liquid to a non-volatile solid concentration of at least 15%, 20%, 25%, 30%, 35%, 40%, 45%, 50%, or the like. The second developer unit 630 may concentrate the first printing liquid from a non-volatile solid concentration of at least 2% (e.g., 2% to 3%, 3% to 5%, 5% to 7%, greater than 7%, etc.), no more than 5% (e.g., less than 1%, 1% to 3%, 3% to 5%, etc.), or the like to a non-volatile solid concentration of at least 13%, 15%, 18%, 20%, 23%, 25%, or the like and deliver it on top of the second printing liquid. The first and second squeegee units may concentrate the first printing liquid or the second printing liquid. The overall non-volatile solid concentration of the first and second printing liquids after the further concentration by the first and second squeegee units 241, 242 may be at least 25%, 30%, 35%, 40%, 45%, 50%, 55%, 60%, or the like. The conveyor 610 may transport the first and second printing liquid to a wiper 650, and the wiper 650 may remove the first and second printing liquid at the concentration. The wiper 650 may remove the first and second printing liquids at normalized rate of at least seven, eight, nine, ten, 13, 15, 18, or the like kilograms per hour. The printing liquid removed by the wiper 650 may be provided for further processing or may be delivered to a storage vessel.

The above description is illustrative of various principles and implementations of the present disclosure. Numerous variations and modifications will become apparent to those skilled in the art once the above disclosure is fully appreciated. Accordingly, the scope of the present application should be determined only by the following claims.

What is claimed is:

1. A system comprising:

a conveyor;

a first developer unit to:

concentrate first printing liquid, and deliver the first printing liquid directly to the conveyor;

a first squeegee unit to apply mechanical and electrical forces to the first printing liquid on the conveyor to remove liquid carrier from the first printing liquid and further concentrate the first printing liquid; and a second developer unit to:

apply mechanical and electrical forces to the removed liquid carrier to separate the removed liquid carrier from residual non-volatile solids present in the removed liquid carrier and to produce second printing liquid containing the residual non-volatile solids, and deliver the second printing liquid directly to the conveyor.

2. The system of claim 1, wherein the first developer unit is to:

output additional liquid carrier produced from concentrating the first printing liquid, wherein the second developer unit is to apply the mechanical and electrical forces to the additional liquid carrier.

3. The system of claim 2, wherein the second developer unit receives the removed liquid carrier from a cleaning tank, the first squeegee unit delivers the removed liquid carrier to the cleaning tank, and the first developer unit receives the first printing liquid from a printing liquid tank and delivers the first printing liquid on top of the second printing liquid.

4. The system of claim 1, further comprising a second squeegee unit to further concentrate the second printing liquid on the conveyor.

5. The system of claim 1, further comprising a cleaning tank, wherein the second developer unit receives the liquid carrier from the cleaning tank and returns the liquid carrier substantially free of non-volatile solids to the cleaning tank.

6. A method comprising:

concentrating first printing liquid on a first developer roller and delivering the concentrated first printing liquid directly to a conveyor;

further concentrating the first printing liquid on the conveyor, wherein further concentrating the first printing liquid produces liquid carrier having a low non-volatile solid concentration;

concentrating the liquid carrier having the low non-volatile solid concentration on a second developer roller to produce second printing liquid, wherein concentrating the liquid carrier having the low non-volatile solid concentration produces liquid carrier substantially free of non-volatile solids;

transferring the second printing liquid from the second developer roller directly to the conveyor; and delivering the liquid carrier substantially free of non-volatile solids to a storage vessel.

7. The method of claim 6, wherein the liquid carrier having the low non-volatile solid concentration has a non-volatile solid concentration of no more than 1% prior to concentrating on the second developer roller.

8. The method of claim 6, wherein the second printing liquid transferred to the conveyor has a non-volatile solid concentration of at least 20%.

9. The method of claim 6, further comprising delivering the liquid carrier having the low non-volatile solid concentration to the storage vessel after the liquid carrier having the low non-volatile solid concentration is produced from concentrating the first printing liquid, wherein concentrating the liquid carrier having the low non-volatile solid concentration on the second developer roller comprises receiving the liquid carrier having the low non-volatile solid concentration from the storage vessel and delivering the printing liquid substantially free of non-volatile solids to the storage vessel until contents of the storage vessel have a non-volatile solid concentration of no more than 0.1%.

10. The method of claim 6, wherein concentrating the first printing liquid comprises receiving the first printing liquid at a non-volatile solid concentration of at least 2%.

11. An apparatus comprising:

a conveyor;

a first printing liquid tank;

a first developer unit to:

concentrate first printing liquid from the first printing liquid tank, and deliver the first printing liquid directly to the conveyor;

a second printing liquid tank to receive liquid carrier removed by the first developer unit during concentration of the first printing liquid; and a second developer unit to:

concentrate second printing liquid from the second printing liquid tank, and deliver the second printing liquid directly to the conveyor.

12. The apparatus of claim 11, further comprising a wiper to remove the first and second printing liquid from the conveyor, wherein the second printing liquid tank receives liquid carrier with a low non-volatile solid concentration from one of the first developer unit and a first squeegee unit, and wherein the first and second printing liquid have an overall non-volatile solid concentration of at least 30% when removed from the conveyor.

13. The apparatus of claim 12, wherein the wiper removes the first and second printing liquid from the conveyor at a normalized rate of at least eight kilograms per hour.

14. The apparatus of claim 11, wherein the first developer unit comprises:

a developer roller to deliver the first printing liquid to the conveyor;

an electrode to concentrate the first printing liquid on the developer roller;

a squeegee roller to further concentrate the first printing liquid on the developer roller; and a cleaner roller to remove undelivered printing liquid from the developer roller.

15. The apparatus of claim 14, wherein the first developer unit comprises an outlet to receive liquid carrier with a low non-volatile solid concentration from the electrode, the squeegee roller, and the cleaner roller, and wherein the outlet is connected to the second printing liquid tank.

16. An apparatus comprising:

a conveyor;

a first printing liquid tank;

a first developer unit to:

concentrate first printing liquid from the first printing liquid tank, and deliver the first printing liquid to the conveyor;

a second printing liquid tank to receive liquid carrier removed by the first developer unit during concentration of the first printing liquid;

a second developer unit to:

concentrate second printing liquid from the second printing liquid tank, and deliver the second printing liquid to the conveyor; and a wiper to remove the first and second printing liquid from the conveyor, wherein the second printing liquid tank receives liquid carrier with a low non-volatile solid concentration from one of the first developer unit and a first squeegee unit, and wherein the first and second printing liquid have an overall non-volatile solid concentration of at least 30% when removed from the conveyor, and wherein the wiper removes the first and second printing liquid from the conveyor at a normalized rate of at least eight kilograms per hour.

* * * * *